US010934039B2

(12) United States Patent
Black et al.

(10) Patent No.: US 10,934,039 B2
(45) Date of Patent: Mar. 2, 2021

(54) SUPPORT SYSTEM FOR FILLING A FLEXIBLE CONTAINER

(71) Applicant: Dow Global Technologies LLC, Midland, MI (US)

(72) Inventors: Marc S. Black, Midland, MI (US); Chad V. Schuette, Midland, MI (US); Brian W. Walther, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 307 days.

(21) Appl. No.: 16/237,058

(22) Filed: Dec. 31, 2018

(65) Prior Publication Data

US 2020/0207489 A1 Jul. 2, 2020

(51) Int. Cl.

| | |
|---|---|
| ***B65B 43/54*** | (2006.01) |
| ***B65B 1/06*** | (2006.01) |
| ***B65B 3/04*** | (2006.01) |
| ***B65B 3/06*** | (2006.01) |

(52) U.S. Cl.

CPC ..... *B65B 43/54* (2013.01); *B65B 1/06* (2013.01); *B65B 3/045* (2013.01); *B65B 3/06* (2013.01)

(58) Field of Classification Search

CPC .. B65B 43/54; B65B 3/00; B65B 3/04; B65B 3/06; B65B 1/00; B65B 1/04; B65B 1/06

See application file for complete search history.

(56) References Cited

U.S. PATENT DOCUMENTS

| | | | | | |
|---|---|---|---|---|---|
| 2,508,945 | A * | 5/1950 | Heuer | B65D 71/50 | 211/75 |
| 3,039,616 | A * | 6/1962 | Proffit | B60N 3/103 | 224/482 |
| 3,087,518 | A * | 4/1963 | Scholle | B65B 3/045 | 141/83 |
| 3,403,826 | A * | 10/1968 | Buford | B65B 3/045 | 222/334 |
| 3,447,281 | A * | 6/1969 | Buford | B65B 3/32 | 53/503 |
| 4,386,636 | A * | 6/1983 | Ellert | B65B 43/123 | 141/10 |
| 5,056,571 | A * | 10/1991 | Derby | B65B 1/04 | 141/114 |
| 5,358,128 | A * | 10/1994 | Belokin | A47B 73/008 | 211/75 |

(Continued)

*Primary Examiner* — Nicolas A Arnett

(74) *Attorney, Agent, or Firm* — Quarles & Brady LLP

(57) ABSTRACT

The present disclosure provides a support system. In an embodiment, the support system includes a top plate and a base plate. The top plate and the base plate have a common outer perimeter. The support system includes a support structure. The support structure supports the top plate above the base plate. The support system includes a pair of parallel rails. The parallel rails extend from the top plate outer perimeter to a closed end at a center portion of the top plate. The pair of parallel rails defines a channel. The support system includes a protrusion on each respective rail. Each protrusion extends into the channel in mirror-image relation to each other. The protrusions are located a fitment width distance away from the closed end. The protrusions and the closed end together define a filling position. The support system includes a fitment for a flexible container in the channel.

17 Claims, 10 Drawing Sheets

(56) References Cited

U.S. PATENT DOCUMENTS 5,558,137 A * 9/1996 Futeman ..... B65B 1/28 137/587
5,678,701 A * 10/1997 Anderson ..... A47F 5/0025 206/490
5,704,495 A * 1/1998 Bale ..... A61B 50/20 211/71.01
6,149,110 A * 11/2000 Gill ..... B65B 43/54 141/114
6,357,713 B1 * 3/2002 Bebow ..... F16M 13/02 248/300
6,776,197 B1 * 8/2004 DeCrane ..... B65B 43/54 141/10
7,353,851 B2 * 4/2008 Sterner ..... B65B 1/06 141/10
7,395,842 B2 * 7/2008 Dyer ..... B65B 3/045 141/10
7,611,102 B2 11/2009 Murray
8,413,409 B2 * 4/2013 Nighy ..... B65B 7/2835 53/281
9,027,748 B1 5/2015 Perkins
9,114,898 B2 * 8/2015 Wehling ..... B65B 51/225
9,346,568 B2 * 5/2016 Korte ..... B65B 43/60
9,352,860 B2 * 5/2016 Vollenkemper ..... B65B 43/60
9,573,716 B2 2/2017 Murray
9,573,737 B2 * 2/2017 Bonekamp ..... B65D 75/008
9,598,192 B2 * 3/2017 Yoshikane ..... B65B 43/50
9,988,167 B2 6/2018 Murray et al.
10,710,753 B2 * 7/2020 Tannarindo ..... B65B 3/17
2006/0196578 A1 * 9/2006 Nyhof ..... B65B 43/54 141/314
2014/0345233 A1 * 11/2014 Parisini ..... B65B 39/12 53/426
2015/0266601 A1 * 9/2015 Vollenkemper ..... B65B 61/28 53/249

* cited by examiner

SUPPORT SYSTEM FOR FILLING A FLEXIBLE CONTAINER

BACKGROUND

Conventional fill lines for large rigid containers typically include conveyer belts and guide rails to keep the rigid containers aligned during the filling process. Incumbent to large volume rigid containers is the ability to be self-supporting. Self-evident is the ability of the large volume rigid container to maintain its shape and position during filling.

In contrast, large volume flexible containers face challenges during filling not encountered by large volume rigid containers. The intrinsic non-rigid and deformable nature of large volume flexible containers can lead to deformation, improper filling, spillage, and even container collapse during the filling process. Additional support equipment is needed to fill such large volume flexible containers—equipment not necessary for the filling of large volume rigid containers. The necessity of additional support equipment leads to an increase in cost and additional production time for the filling of large volume flexible containers.

The art recognizes the need for a support system to support large volume flexible containers during filling. A need further exists for a support system for large volume flexible containers that can be used on conventional fill lines for large volume rigid containers.

SUMMARY

The present disclosure provides a support system. In an embodiment, the support system includes a top plate and a base plate. The top plate and the base plate have a common outer perimeter. The support system includes a support structure. The support structure supports the top plate above the base plate. The support system includes a pair of parallel rails. The parallel rails extend from the top plate outer perimeter to a closed end at a center portion of the top plate. The pair of parallel rails defines a channel. The support system includes a protrusion on each respective rail. Each protrusion extends into the channel in mirror-image relation to each other. The protrusions are located a fitment width distance away from the closed end. The protrusions and the closed end together define a filling position. The support system includes a fitment for a flexible container in the channel.

Definitions

Any reference to the Periodic Table of Elements is that as published by CRC Press, Inc., 1990-1991. Reference to a group of elements in this table is by the new notation for numbering groups.

For purposes of United States patent practice, the contents of any referenced patent, patent application or publication are incorporated by reference in their entirety (or its equivalent U.S. version is so incorporated by reference) especially with respect to the disclosure of definitions (to the extent not inconsistent with any definitions specifically provided in this disclosure) and general knowledge in the art.

The numerical ranges disclosed herein include all values from, and including, the lower and upper value. For ranges containing explicit values (e.g., 1 or 2, or 3 to 5, or 6, or 7), any subrange between any two explicit values is included (e.g., the range 1-7 above includes subranges of 1 to 2; 2 to 6; 5 to 7; 3 to 7; 5 to 6; etc.).

Unless stated to the contrary, implicit from the context, or customary in the art, all parts and percents are based on weight and all test methods are current as of the filing date of this disclosure.

The term "composition" refers to a mixture of materials which comprise the composition, as well as reaction products and decomposition products formed from the materials of the composition.

The terms "comprising," "including," "having" and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term "consisting essentially of" excludes from the scope of any succeeding recitation any other component, step, or procedure, excepting those that are not essential to operability. The term "consisting of" excludes any component, step, or procedure not specifically delineated or listed. The term "or," unless stated otherwise, refers to the listed members individually as well as in any combination. Use of the singular includes use of the plural and vice versa.

A "polymer" or a "polymeric material" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

DETAILED DESCRIPTION

The present disclosure provides a support system. The support system includes a top plate, a base plate, and a support structure that supports the top plate above the base plate. The top plate and the base plate have a common outer perimeter. A pair of parallel rails extends from the top plate outer perimeter to a closed end at a center portion of the top plate, with the rails defining a channel. A protrusion is located on each respective rail, with each protrusion extending into the channel in mirror-image relation to each other. The protrusions are located a fitment width distance away from the closed end at the center portion of the top plate. The protrusions and the closed end at the center portion of the top plate together define a fill position. A fitment of a flexible container is located within the channel.

Figure 1:
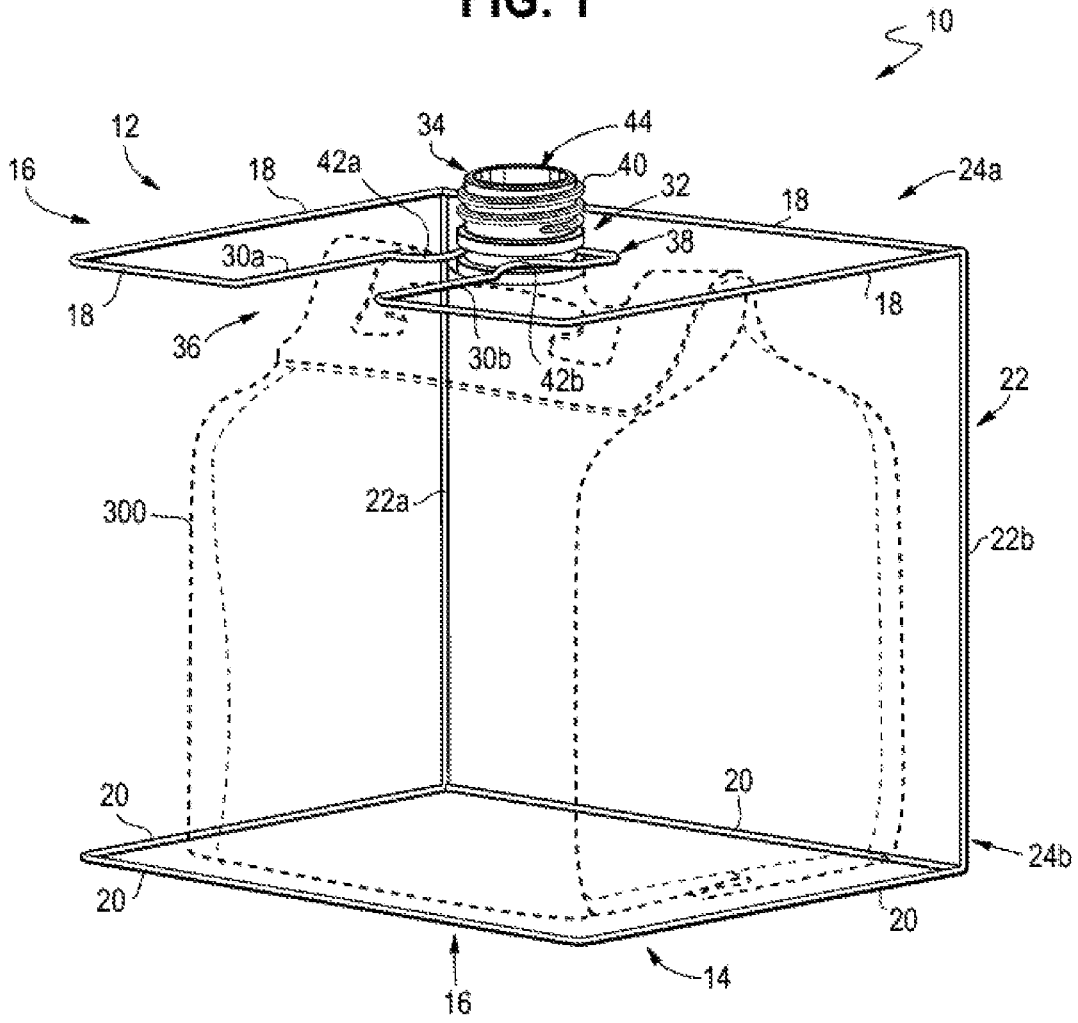
FIG. 1 is a perspective view of an embodiment of a support system in accordance with an embodiment of the present disclosure.

The present disclosure provides a support system 10, as shown in FIG. 1. The support system 10 includes a top plate 12 and a base plate 14. Each of the top plate 12 and the base plate 14 is a flat, or a substantially flat, substrate. The top plate 12 and the base plate 14 each can have a frame structure, or otherwise an open structure. Alternatively, top plate 12 and base plate 14 each can have a solid structure, or otherwise an enclosed structure or a closed structure.

The top plate 12 and the base plate 14 have, or otherwise define, a common outer perimeter 16. The term "common outer perimeter," as used herein, refers to the shape, or outline, defined by an outermost edge of two or more objects (from top plan view), the shape (or outline) of each object being the same. In other words, the term "common outer perimeter" indicates that the top plate 12 and the base plate 14 have the same outermost outline (from top plan view). The parallel rails are not part of the outermost outline which defines the common outer perimeter. Top plate 12 is positioned, or otherwise oriented, so that the outermost outline for the top plate 12 is aligned with the outermost outline of the base plate 14, defining the common outer perimeter and enabling placement of a flexible container between the top plate 12 and the base plate 14, as will be described in detail below.

The common outer perimeter is a polygon (irregular polygon or regular polygon). In an embodiment, the common outer perimeter is a regular polygon, with "n" number of sides, wherein "n" is greater than or equal to 4. In an embodiment, the common outer perimeter is a regular polygon wherein n is equal to 4. Non-limiting examples of suitable regular polygon shapes for the common outer perimeter include a square and a rectangle.

In an embodiment, the common outer perimeter is a regular polygon (square or rectangle) and includes a plurality of corners (four corners). The corners of the top plate 12 are aligned with respective corners of the base plate 14, such that if the top plate is superimposed on the bottom plate, the corners would align and the top plate 12 and the base plate 14 are aligned.

In an embodiment, support system 10 includes top plate 12 with an open frame structure and having an outermost outline that is a square. Base plate 14 has an open frame structure and also has an outermost outline that is a square. The top plate 12 and the base plate 14 define a common outer perimeter 16 that is a square as shown in FIG. 1.

Beam 18 forms the open frame structure for top plate 12. Similarly beam 20 forms the open frame structure for base plate 14. Beams 18, 20 have a gauge, or a diameter, or a thickness, sufficient to provide the strength necessary to support a filled flexible container without collapse of support structure 10. Beam 18 (and beam 20) can be a single integral piece formed, or otherwise shaped, to the frame shape of top plate 12 (or base plate 14). Alternatively, beam 18 (and/or beam 20) can be composed of a plurality of individual sub-beams adhered, bonded, or otherwise welded together. Each side of the top plate 12 (and/or base plate 14) can be a separate sub-beam bonded, or otherwise welded, to other sub-beams to form the top plate 12 (and/or base plate 14) with frame structure. Nonlimiting examples of suitable materials for beams 18, 20 include metal, steel, aluminum, polymeric material, wood, fiberglass, carbon fiber and combinations thereof.

Non-limiting examples of suitable polymeric materials for beams 18, 20 include glass filled and/or neat polymeric materials such as high density polyethylene, polypropylene, polycarbonate, polyamide, high impact polystyrene (HIPS), acrylonitrile butadiene styrene (ABS), and poly(p-phenylene oxide) (PPO) blended with polystyrene, polyamide, polyester resin, epoxy resin, polyurethane, rubber (natural rubber or synthetic rubber), and combinations thereof.

The present support system includes a support structure. The support structure supports the top plate above the base plate. The support structure is a flat, or a substantially flat, substrate. The support structure can have a frame structure, or otherwise an open structure. Alternatively, the support structure can have a solid structure, or otherwise a closed structure.

FIG. 1 shows an embodiment wherein support system 10 includes a support structure 22 that is a frame structure, the support structure including a plurality of vertical beams 22*a*, 22*b*. Beams 22*a*, 22*b* adjoin a first side 24*a* of top plate 12 with a corresponding first side 24*b* of the base plate 14 to form a frame structure, or otherwise an open structure, for support structure 22. Beams 22*a*, 22*b* each has a gauge, or a diameter, or a thickness, sufficient to provide the strength necessary to support a filled flexible container between the top plate and the bottom plate without collapse of support structure 10. Beam 22*a*, 22*b* each can be a single integral piece. Alternatively, beam 22*a*, 22*b* each can be composed of a plurality of individual sub-beams, the sub-beams with retract-ability/extend-ability (in telescoping arrangement, for example), thereby enabling the distance between top plate 12 and base plate 14 to be varied. Retractable and/or extendible beams 22*a*, 22*b* advantageously enable support system 10 to support flexible containers of varying sizes and support flexible containers of varying volumes.

Beams 22*a*, 22*b* can be made of any material as the material selection for beams 18, 20 as disclosed above. Non-limiting examples of suitable materials for beams 22*a*, 22*b* include metal, steel, aluminum, polymeric material, wood, fiberglass, carbon fiber and combinations thereof.

Beams 22*a*, 22*b* may or may not be located at the corners of first side 24*a*, 24*b* of respective plates 12, 14. In an embodiment, beams 22*a*, 22*b* are located at respective corners along first sides 24*a*, 24*b* as shown in FIG. 1. Although FIG. 1 shows support system 10 with two beams, it is understood that the support structure 20 may include two, three, four, five, six or more beams to securely, and rigidly, support the top plate 12 above the base plate 14.

In an embodiment, support structure 20 includes two beams 22*a*, 22*b* each beam located at the corner of respective first side 24*a*, 24*b*, beam 22*a* parallel to, or substantially parallel to beam 22*b* as shown in FIG. 1.

The present support system includes a pair of parallel rails. FIG. 1 shows support system 10 with parallel rails 30*a*, 30*b*, extending from the outer perimeter 16 of top plate 12 to a closed end 32. Closed end 32 is located at a center portion 34 of top plate 12. Parallel rails 30*a*, 30*b*, define a channel 36. The closed end 32 includes, or is otherwise defined by, an arc segment 38. The arc segment 38 extends between the parallel rails 30*a*, 30*b* and connects or otherwise adjoins rails 30*a* to 30*b*. The arc segment 38 is a curve adapted to reciprocate and receive a portion of a fitment 40, which has a round perimeter. The parallel rails 30*a*, 30*b* prevent the fitment 40 from falling out of the channel 36 both while sliding through the channel 36, and while held in place by the arc segment 38. The fitment 40 is described further below.

Each rail 30*a*, 30*b* includes a respective protrusion 42*a*, 42*b*, as shown in FIG. 1. Each protrusion 42*a*, 42*b* extends inward from the respective rail 30*a*, 30*b* into the channel 36. The protrusions 42*a*, 42*b* are in mirror-image relation to each other. The term "mirror-image relation," as used herein, refers to a relationship of two identical structures (i.e. protrusions 42*a*, 42*b*) that, when superimposed on each other about a line of symmetry, have an exact alignment with each other. The width of the channel 36 between the protrusions 42*a*, 42*b* is less than the width of the rest of the channel 36. The protrusions 42*a*, 42*b* are not in contact with one another.

The protrusions 42*a*, 42*b* are spaced away from the closed end 32 at the center portion 34 of the top plate 12 by a fitment width distance. The term "fitment width distance," as used herein, refers to a distance from the closed end at the center portion of the top plate to the protrusions that is equal to, or substantially equal to, the width of the fitment. In other words, the fitment 40 rests securely, or otherwise snugly, between the closed end 32 and the protrusions 42*a*, 42*b*, such that little, or no, movement of the fitment 40 occurs along the parallel rails 30*a*, 30*b* when the fitment 40 is located between the closed end 32 and the protrusions 42*a*, 42*b*. The protrusions 30*a*, 30*b* allow the fitment 40 to slide through to the closed end 32 at the center portion 34 of the top plate 12. The protrusions 42*a*, 42*b* and the closed end 32 at the center portion 34 of the top plate 12 together define a filling position 44. The term "filling position," as used herein, refers to the position of the fitment 40 when locked in place, or otherwise immobilized by the protrusions 42*a*, 42*b* and the closed end 32 at the center portion 34 of the top plate 12. Little movement, or no movement, of the fitment 40 occurs when fitment 40 is at the filling position.

The parallel rails and the protrusions are made of the same material as the material of the top plate. Alternatively, the parallel rails and/or the protrusions are made of one or more materials that are different than the material of the top plate. In an embodiment, top plate 12 (beam 18), parallel rails 30*a*, 30*b*, and protrusions 42*a*, 42*b* are an integral, or unitary, single component. Nonlimiting examples of suitable material for the integral component of top plate 12 (beam 18), parallel rails 30*a*, 30*b* and protrusions 42*a*, 42*b* include metal, steel, aluminum, polymeric material, wood, fiberglass, carbon fiber, rubber, and combinations thereof.

Figure 2:
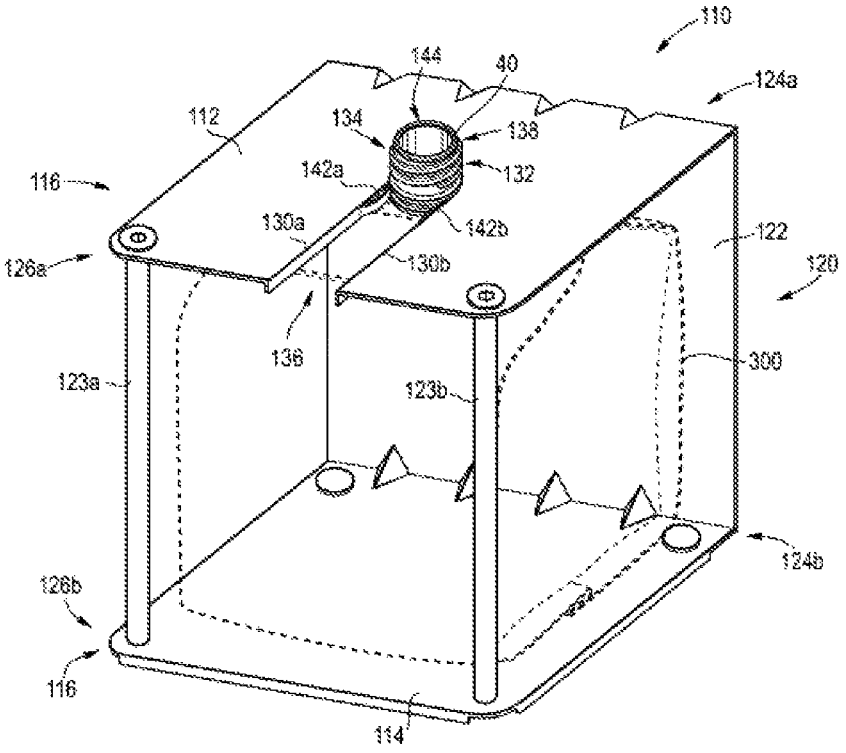
FIG. 2 is a perspective view of a support system in accordance with an embodiment of the present disclosure.

FIG. 2 shows another embodiment wherein a support system 110 includes top plate 112 and base plate 114. Top plate 112 and 114 each is a solid substrate, top/base plates 112, 114 otherwise being "closed" structures (as opposed to the open frame structure of support system 10). The size and shape of the support system 110 is constructed to reduce, or otherwise to prevent, tipping of the support system when supporting a filled large volume flexible container. It is understood that the support system can be constructed so that the center of gravity is below half height of the support system when supporting a filled large volume flexible container.

In an embodiment, the mass of the base plate 114 is greater than the mass of the top plate 112, to ensure stability of the support system 110. A weight plate of a high density material (such as steel, for example) can be attached to base plate 114 (not shown) to ensure that the base plate 114, is heavier than the combined weight of top plate 112 and the filled flexible container, thus ensuring stability of the support system 110.

Top plate 112 and base plate 114 have a common outer perimeter. The common outer perimeter can be any shape as previously discussed herein. In an embodiment, support system 110 includes a common outer perimeter that is a polygon, such as common outer perimeter 116 that is a square as shown in FIG. 2.

Support system 110 includes a support structure 120 that includes a vertical wall 122 and rods 123*a*, 123*b*. Vertical wall 122 adjoins, or otherwise attaches, a first side 124*a* of top plate 112 with a corresponding first side 124*b* of the base plate 114. Nonlimiting examples of suitable materials for vertical wall 122 include metal, steel, aluminum, polymeric material, wood, fiberglass, carbon fiber and combinations thereof. In an embodiment, vertical wall 120 is attached to both the top plate 112 and the base plate 114 by way of a plurality of bolts (not shown).

In an embodiment top plate 112, base plate 114, and vertical wall 122 are components of a single unitary integral component such as a sheet of metal, for example. The single unitary component is shaped, or otherwise bent, to form the right angle between top plate 112 and vertical wall 122 and to form the right angle between the base plate 114 and the vertical wall 122. In a further embodiment, the single unitary integral component (from which top/base plates 112, 114 and vertical wall 122 are formed) is a single piece of sheet metal formed in a unitary sideways "u-shape" as shown in FIG. 2.

Rods 123*a*, 123*b* are spaced apart and adjoin, or otherwise attach, a second side 126*a* of top plate 112 with a corresponding second side 126*b* of the base plate 114. The second sides 126*a*, 126*b* are opposite to the first sides 124*a*, 124*b* as shown in FIG. 2. Support structure 120 (vertical wall 122 and rods 123*a*, 123*b*) supports the top plate 112 above the base plate 114.

Rods 123*a*, 123*b* adjoin the second sides 126*a*, 126*b* to form a frame structure, or otherwise an open structure, on the second sides 126*a*, 126*b* of respective top plate 112 and base plate 114. Rods 123*a*, 123*b* each has a gauge, or a diameter, or a thickness, sufficient to provide the strength necessary to support a filled flexible container between the top plate and the bottom plate without collapse of support structure 110. In an embodiment, each rod 123*a*, 123*b* is attached to both the top plate 112 and the base plate 114 by a plurality of bolts (not shown).

Rods 123*a*, 123*b* can be made of any material as the material selection for beams 18, 20 as disclosed above. Nonlimiting examples of suitable material for rods 123*a*, 123*b* include metal, steel, aluminum, polymeric material, wood, fiberglass, carbon fiber and combinations thereof.

Rods 123*a*, 123*b* may or may not be located at the corners of second side 126*a*, 126*b* of respective top/base plates 112, 114. In an embodiment, rods 123*a*, 123*b* are located at respective corners along second sides 126*a*, 126*b* as shown in FIG. 2. Although FIG. 2 shows support system 110 with two rods, it is understood that the support structure 120 may include two, three, four, five, six or more rods to securely, and rigidly, support the top plate 112 above the base plate 114.

In an embodiment, the second side of each respective top/base plate 112, 114 has two corners. Support structure 120 includes two rods 123*a*, 123*b*, each rod located at a corner of respective second sides 126*a*, 126*b*. Rod 123*a* is parallel to, or substantially is parallel to, rod 123*b* as shown in FIG. 2. Each rod 123*a*, 123*b* extends between the second side 126*a* of the top plate and the second side 126*b* of the base plate as shown in FIG. 2. The support structure 120 (vertical wall 122 and rods 123*a*, 123*b*) prevents guide rails of a conveyor system from contacting the flexible container supported by the support system 110 during the filling process.

FIG. 2 shows support system 110 with parallel rails 130*a*, 130*b*, extending from the outer perimeter 116 of top plate 112 to a closed end 132. Closed end 132 is located at a center portion 134 of top plate 112. Parallel rails 130*a*, 130*b*, define a channel 136. The closed end 132 includes, or is otherwise defined by, an arc segment 138. The arc segment 138 extends between the parallel rails 130*a*, 130*b* and connects or otherwise adjoins rails 132*a* to 132*b*. The arc segment 138 is a curve adapted to reciprocate and receive a portion of a fitment 40, which has a round perimeter. The parallel rails 130*a*, 130*b* prevent the fitment 40 from falling out of the channel 136 both while sliding through the channel 136, and while held in place by the arc segment 138. The fitment 40 is described further below.

Each rail 130*a*, 130*b* includes a respective protrusion 142*a*, 142*b*, as shown in FIG. 2. Each protrusion 142*a*, 142*b* extends inward from the respective rail 130*a*, 130*b* into the channel 136. The protrusions 142*a*, 142*b* are in mirror-image relation to each other. The width of the channel 136 between the protrusions 142*a*, 142*b* is less than the width of the rest of the channel 136. The protrusions 142*a*, 142*b* are not in contact with one another.

The protrusions 142*a*, 142*b* are spaced away from the closed end 132 at the center portion 134 of the top plate 112 by a fitment width distance. In other words, the fitment 40 rests securely, or otherwise snugly, between the closed end 132 and the protrusions 142*a*, 142*b*, such that little, or no, movement of the fitment 40 occurs along the parallel rails 130*a*, 130*b* when the fitment 40 is located between the closed end 132 and the protrusions 142*a*, 142*b*. The protrusions 130*a*, 130*b* allow the fitment 40 to slide through to the closed end 32 at the center portion 134 of the top plate 112. The protrusions 142*a*, 142*b* and the closed end 132 at the center portion 134 of the top plate 112 together define a filling position 144.

The parallel rails and the protrusions are made of the same material as the material of the top plate. Alternatively, the parallel rails and/or the protrusions are made of one or more materials that are different than the material of the top plate. In an embodiment, top plate 112, parallel rails 130*a*, 130*b*, and protrusions 142*a*, 142*b* are an integral, or unitary, single component. Nonlimiting examples of suitable material for the integral component of top plate 112, parallel rails 130*a*, 130*b* and protrusions 142*a*, 142*b* include metal, steel, aluminum, polymeric material, wood, fiberglass, carbon fiber, rubber, and combinations thereof.

Figure 3:
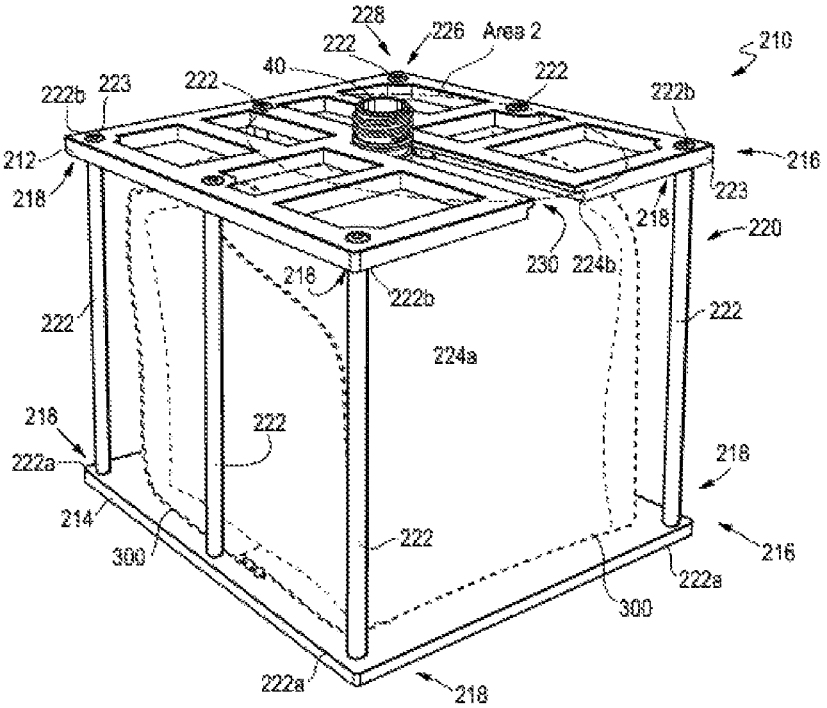
FIG. 3 is a perspective view of a support system in accordance with an embodiment of the present disclosure.

FIG. 3 shows another embodiment wherein a support system 210 includes top plate 212 and base plate 214. Top plate 212 is a "web-substrate" having a plurality of openings in an otherwise solid plate (or closed plate), the web substrate having a degree of open structure that is less than the degree of open structure as the frame structures for the top/base plates as shown is support system 10, for example. The web-substrate allows for a reduction in weight, a reduction in material for top plate 212, and a reduction in cost for top plate 212. It is understood that base plate 214 can have a web-substrate structure similar to the web-structure for top plate 212.

In an embodiment, base plate 214 is a solid substrate, or otherwise is a "closed" structure (as opposed to the open frame structure of support system 10).

The top plate 212 and the base plate 214 each have a common outer perimeter which is a polygon, such as a square 216 as shown in FIG. 3.

Top/base plate 212, 214 can be made of any material for plates as previously disclosed herein. Nonlimiting examples of suitable materials for top plate 212 and base plate 214 include metal, steel, aluminum, polymeric material, wood, fiberglass, carbon fiber and combinations thereof. Nonlimiting examples of suitable polymeric materials for top plate 212 and base plate 214 include glass filled and/or neat polymeric materials such as high density polyethylene, polypropylene, polycarbonate, polyamide, high impact polystyrene (HIPS), acrylonitrile butadiene styrene (ABS), and poly(p-phenylene oxide) (PPO) blended with polystyrene, polyamide, polyester resin, epoxy resin, polyurethane, rubber (natural rubber or synthetic rubber), and combinations thereof.

Support system 210 includes a support structure 220. Support structure 220 includes a plurality of rods 222. FIG. 3 shows the rods 222 spaced apart along the common outer perimeter 216 for each of the top plate 212 and the base 214. The rods 222 support the top plate 212 above the base 214. A first end 222*a* of a rod 222 is located at a corner 218 of the outer perimeter 216 of the base plate 214, with the rod 222 extending vertically, or substantially vertically, with a second end 222*b* of the rod 222 meeting a corner 218 of the common outer perimeter 216 of the top plate 212.

In an embodiment, the first end 222*a* of each rod 222 is attached to the base plate 214 with bolts 223. The second end 222*b* of each rod 222 is attached to the top plate 212 with bolts 223, shown in FIG. 3. The bolts 223 also reduce friction on a support surface upon which the support system 210 rests.

The support structure 220 includes a sufficient number of rods 222 to securely, and rigidly, support the top plate 212 above the base plate 214. It is understood that the number of rods 222 depends on the size and shape of the common outer perimeter 216. The number of rods 222 may be from three, or four, to six, or seven, or eight, or more.

In an embodiment, when the common outer perimeter 216 is a regular polygon (such as a square, for example), the support system 210 includes a rod 222 at each corner of the regular polygon. Each rod 222 extends between and is attached to the top plate 212 and the base plate 214 as previously disclosed. It is understood that for further support, the support system 210 can have one or more rods 222 along the common outer perimeter 216 in addition to a rod 222 at each corner 18. FIG. 3, for example, shows an embodiment wherein the common outer perimeter 216 is a square with a rod 222 at each of the four corners of the square, and an additional three rods 222 at midpoints along three of the four sides of the square.

The rods 222 can be made of any material for plates as previously discussed herein. Non-limiting examples of suitable material for rods 222 include metal, steel, aluminum, polymeric material, wood, fiberglass, carbon fiber, and combinations thereof.

In an embodiment, the rods 222 are made of metal. Non-limiting examples of suitable metal include aluminum, steel, iron, titanium, and combinations thereof.

In an embodiment, the rods 222 are made of a rigid polymeric material. Non-limiting examples of suitable rigid polymeric material include polyethylene, polypropylene, polyethylene terephthalate, and combinations thereof.

In an embodiment, the rods 222 are made of a fiberglass. Non-limiting examples of the fiberglass include polyester resin, epoxy resin, and combinations thereof.

In an embodiment, each of the plurality of rods 222 has a cross-sectional shape. The cross-sectional shape of each rod 222 can be a circle, an ellipse, an irregular polygon, or a regular polygon. In an embodiment, the cross-sectional shape of each of the rods 222 is a circle or an ellipse. In another embodiment, the cross-sectional shape of each of the rods 222 is a regular polygon, with "n" number of sides, wherein "n" is greater than or equal to 3. Non-limiting examples of suitable regular polygon shapes for the common outer perimeter 16 include a square, a rectangle, a triangle, a pentagon, and a hexagon.

In an embodiment each of the plurality of rods 222 has a shape of a cylinder, with a cross-sectional shape of a circle or an ellipse.

In an embodiment each of the plurality of rods 222 has a shape of a rectangular prism, with a cross-sectional shape selected from the group of a rectangle and a square.

In an embodiment each of the plurality of rods 222 has a shape of a triangular prism, with a cross-sectional shape of a triangle.

The following disclosure for FIGS. 4A, 4B, 4C, 5A, 5B, 6A, 6B, 7A, and 7B relates to Area 2 of FIG. 3 for support system 210. It is understood that the following disclosure to Area 2 applies equally to support systems 10, 110 and the respective parallel rails, closed end, center portion of top plate, channel, arc segment, protrusions and filling position for support system 10 and support system 110.

Figure 4A:
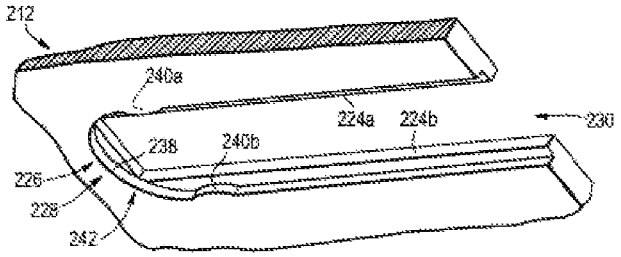
FIG. 4A is a bottom perspective view of Area 2 of FIG. 3.
Figure 4B:
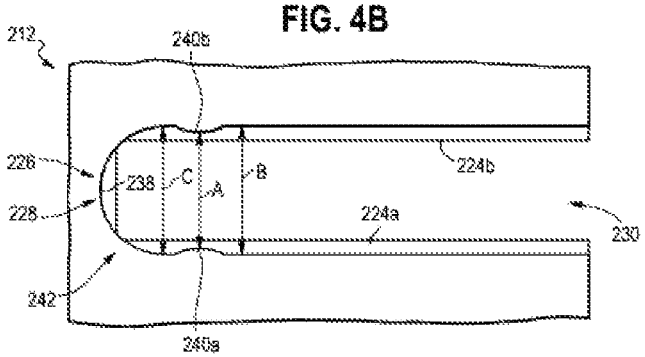
FIG. 4B is a bottom plan view of Area 2 of FIG. 3.
Figure 4C:
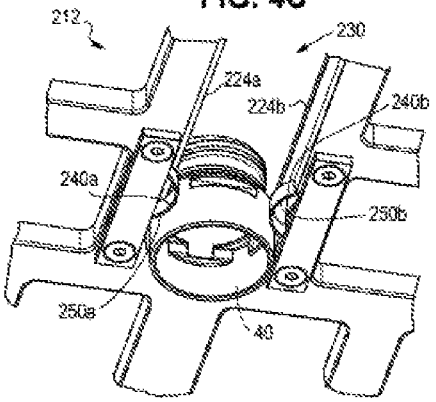
FIG. 4C is a bottom perspective view of another embodiment of Area 2 of FIG. 3, wherein the protrusions are springs.

Support system 210 includes a pair of parallel rails 224*a*, 224*b*, as shown in Area 2 in FIG. 3, and also shown in FIGS. 4A-4C. The parallel rails 224*a*, 224*b* extend from the common outer perimeter 216 of the top plate 212 to a closed end 226 at a center portion 228 of the top plate 212. The parallel rails 224*a*, 224*b* define a channel 230.

In an embodiment, shown in FIG. 4A, the closed end 226 at the center portion 228 of the frame 212 includes, or is defined by, an arc segment 238. The arc segment 238 extends between the parallel rails 224*a*, 224*b* and connects, or otherwise adjoins, the parallel rails 224*a* and 224*b*. As shown in FIG. 4A, the arc segment 238 is a curve adapted to reciprocate and receive a portion of fitment 40, which has a round perimeter. The fitment 40 is discussed further below.

Each of the parallel rails 224*a*, 224*b* includes a protrusion 240*a*, 240*b*, as shown in FIG. 4B. Each protrusion 240*a*, 240*b* extends inward from the respective rail 224*a*, 224*b* into the channel 230. The protrusions 240*a*, 240*b* are in mirror-image relation to each other. As shown in FIG. 4B, the width of the channel 230 between the protrusions 240*a*, 240*b* (width A) is less than the width (width B) of the rest of the channel 230. The width C at filling position 242 is the same, or substantially the same, as width B. The protrusions 240*a*, 240*b* are not in contact with one another.

Figure 5A:
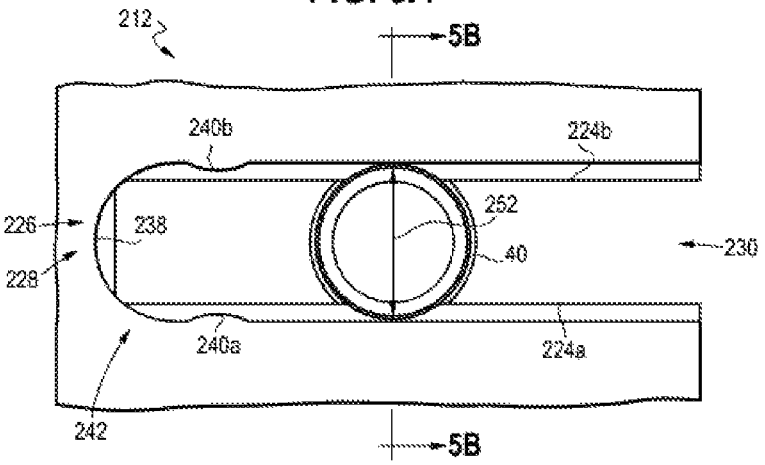
FIG. 5A is a bottom plan view of Area 2 of FIG. 3 and a fitment sliding along the pair of parallel rails, in accordance with an embodiment of the present disclosure.
Figure 7A:
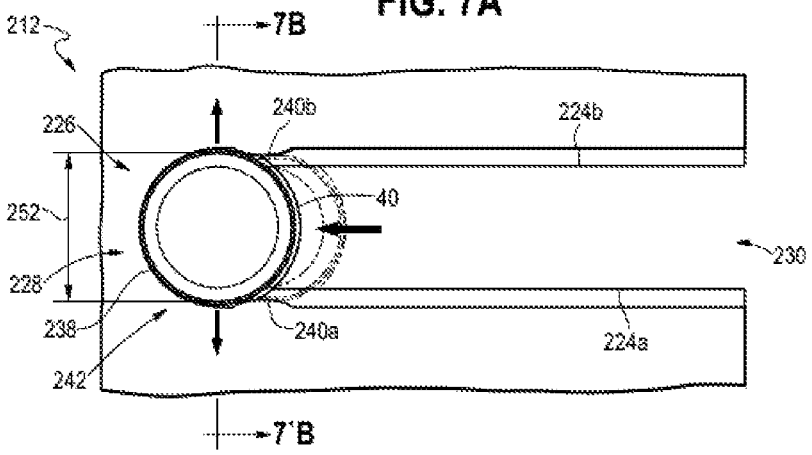
FIG. 7A is a bottom plan view of Area 2 of FIG. 3 and the fitment locking into place by the rigid plastic protrusions, and held at the closed end at the center portion of the top plate.

The protrusions 240*a*, 240*b* are spaced away from the closed end 226 at the center portion 228 of the frame 212 by a fitment width distance, as shown in FIG. 5A. In other words, the fitment 40 rests securely, or otherwise snugly, between the closed end 226 and the protrusions 240*a*, 240*b*, such that little, or no, movement of the fitment 40 occurs along the rails 224*a*, 224*b* when the fitment 40 is located between the closed end 226 and the protrusions 240*a*, 240*b*. As shown in FIG. 4A, the protrusions 240*a*, 240*b* allow the fitment 40 to slide through to the closed end 226 at the center portion 228 of the top plate 212. The protrusions 240*a*, 240*b* and the closed end 226 at the center portion 228 of the top plate 212 together define a filling position 242, as shown in FIG. 7A.

In an embodiment, shown in FIG. 4A and FIG. 4B, the top plate 212, the protrusions 240*a*, 240*b* and the parallel rails 224*a*, 224*b* are an integral, or unitary, component, and the top plate 212, protrusions 240*a*, 240*b* and the rails 224*a*, 224*b* are composed of the same material. Non-limiting examples of the material used for top plate 212, the protrusions 240*a*, 240*b* and the parallel rails 224*a*, 224*b* include metal, rigid polymeric material, rubber, and combinations thereof. In a further embodiment, the top plate 212, the parallel rails 224*a*, 224*b*, and the protrusions 240*a*, 240*b* are an integral, or unitary component, the integral component of the top plate 212, the parallel rails 224*a*, 224*b*, and the protrusions 240*a*, 240*b* composed of the same material.

In an embodiment, the top plate 212, the parallel rails 224*a*, 224*b* and the protrusions 240*a*, 240*b* are made of a metal. Non-limiting examples of the metal include aluminum, steel, iron, titanium, and combinations thereof.

In an embodiment, the top plate 212, the parallel rails 224*a*, 224*b* and the protrusions 240*a*, 240*b* are made of a rigid polymeric material. Non-limiting examples of the rigid polymeric material include polyethylene, polypropylene, polyethylene terephthalate, ethylene/alpha-olefin block copolymers, and combinations thereof.

In an embodiment, the top plate 212, the parallel rails 224*a*, 224*b* and the protrusions 240*a*, 240*b* are made of a rubber. Non-limiting examples of the rubber include silicone, polyurethane, latex, nitrile, and combinations thereof.

Figure 6A:
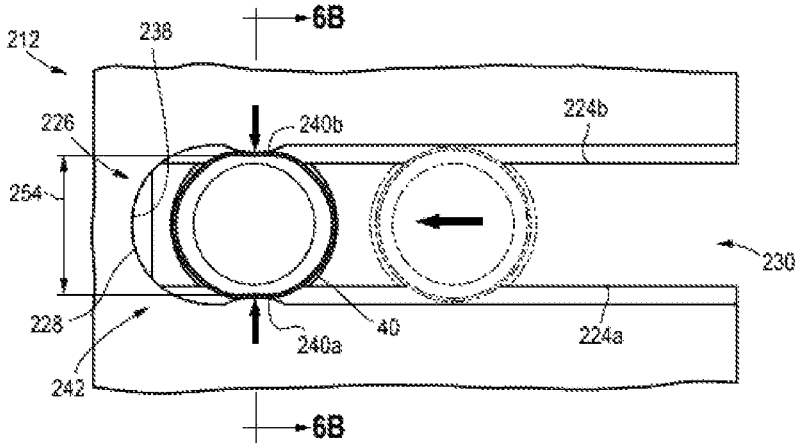
FIG. 6A is a bottom plan view of Area 2 of FIG. 3 and the fitment in contact with the rigid plastic protrusions, in accordance with an embodiment of the present disclosure.
Figure 6B:
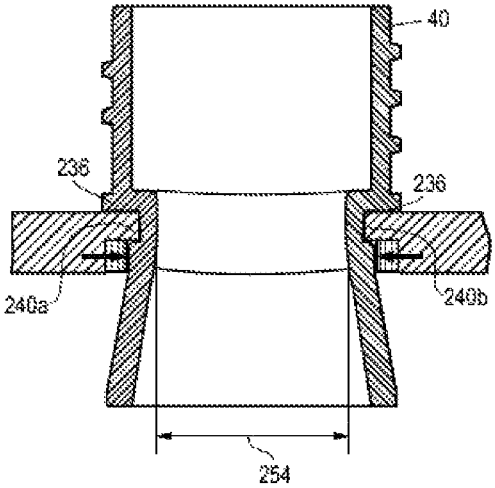
FIG. 6B is a sectional view taken along line 6B-6B of FIG. 6A.

In an embodiment, shown in FIG. 4C, the protrusions 240*a*, 240*b* are springs 250*a*, 250*b* attached to respective parallel rails 224*a*, 224*b*. In another embodiment, one of each of the springs 250*a*, 250*b* is attached to one of each of the parallel rails 224*a*, 224*b*. The springs 250*a*, 250*b* are leaf springs that contract to allow the fitment 40 of the container 234 to slide along to the closed end 226 at the center portion 228 of the top plate 212, as shown in FIG. 6A.

Non-limiting examples of the material used for the springs 250*a*, 250*b* include metal, polymeric material, rubber, and combinations thereof.

In an embodiment, the springs 250*a*, 250*b* are made of a metal. Non-limiting examples of the metal include aluminum, steel, iron, titanium, and combinations thereof.

Figure 5B:
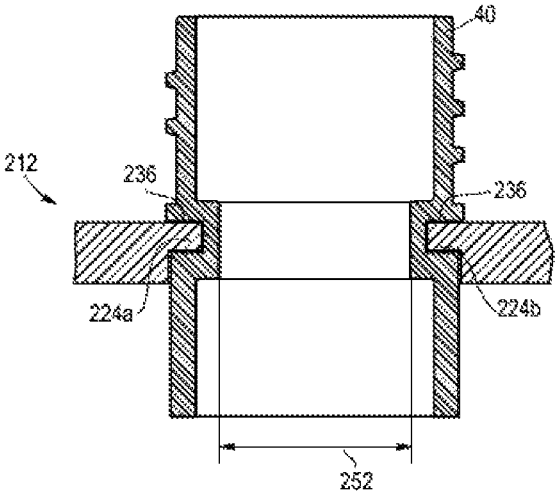
FIG. 5B is a sectional view taken along line 5B-5B of FIG. 5A.

The support system 210 includes a fitment 40. Support system 10 and support system 110 each also includes fitment 40. The following disclosure to support system 210 and fitment 40 applies equally to support system 10 and fitment 40 and support system 110 and fitment 40. The fitment 40 is inserted into the channel 230 at the common outer perimeter 216 of the top plate 212. Once inserted, the fitment 40 slides through the channel 230, shown in FIG. 5A. The fitment 40 may be inserted into the channel 230 either manually or mechanically. As shown in FIG. 5A, the fitment 40 fits into, and slides through, the channel 230 (i.e. along the parallel rails 224*a*, 224*b*), to arrive at the closed end 226 at the center portion 228 of the top plate 212. The fitment 40 has a groove 236 for sliding engagement with the parallel rails 224*a*, 224*b* as shown in FIG. 5B. The term "sliding engagement," as used herein, refers to the mating of the groove 236 of the fitment 40 with the parallel rails 224*a*, 224*b*, such that the groove 236 of the fitment 40 moves freely along the parallel rails 224*a*, 224*b* in both a forward direction (towards the closed end 226 at the center portion 228 of the top plate 212) and a backward direction (towards the outer perimeter 216 of the top plate 212). The fitment 40 has two ends, with each of the ends of the fitment 40 resting fully on a respective parallel rail 224*a*, 224*b* while sliding along the parallel rails 224*a*, 224*b*.

In an embodiment, the top plate 212 includes a rail opening at common outer perimeter 216. At the rail opening, the rails are spaced apart so that the channel at the outer perimeter is wider than the fitment diameter. Moving along the rails from the rail opening toward the closed end, the rails taper toward each other and the rails become parallel, the parallel rails enabling sliding engagement with the groove of the fitment. The wider channel (greater than fitment diameter) at the rail opening eases insertion and removal of the fitment into/out of the sliding engagement of the parallel rails. The wider channel and the tapered rails at the rail opening give the rails a funnel-like appearance from a top plan view of the top plate 112.

The parallel rails and/or the rail opening may be coated with a low coefficient of friction material (such as Teflon, for example) to assist with easy sliding of the fitment onto the parallel rails.

The fitment 40 has a neutral diameter 252, shown in FIG. 5A and FIG. 5B. While sliding through the channel 230, the width of the fitment 40 is equal to the neutral diameter 252. In other words, the width of the fitment 40 is unchanged (neither expanded nor compressed) while sliding through the channel 230, until the fitment 40 arrives between the protrusions 240*a*, 240*b*.

The fitment 40 slides through the channel 230 until reaching the protrusions 240*a*, 240*b*. As shown in FIG. 6A, once the fitment 40 reaches the protrusions 240*a*, 240*b*, the neutral diameter 252 contracts to the compressed diameter 254 to allow the fitment 40 to pass between the protrusions 240*a*, 240*b*. When the opposing ends of the fitment 40 are sandwiched by the protrusions 240*a*, 240*b*, the fitment 40 has a compressed diameter 254. The compressed diameter 254 (FIGS. 6A and 6B) is smaller than, or less than, the neutral diameter 252 (FIG. 5A and FIG. 5B) of the fitment 40. The fitment 40 is made of a flexible or semi-rigid polymeric material providing fitment 40 with sufficient elasticity to compress when pushed between the protrusions 240*a*, 240*b*. In other words, the fitment 40 has a resiliency to compress to the compressed diameter 254 when slid between the protrusions 40*a*, 40*b* and subsequently expand back to the neutral diameter 252 when further slid to the filling position 242. Non-limiting examples of suitable polymeric material for the fitment 40 include polyethylene (such as high density polyethylene, for example) and ethylene/α-olefin multi-block copolymer.

Figure 7B:
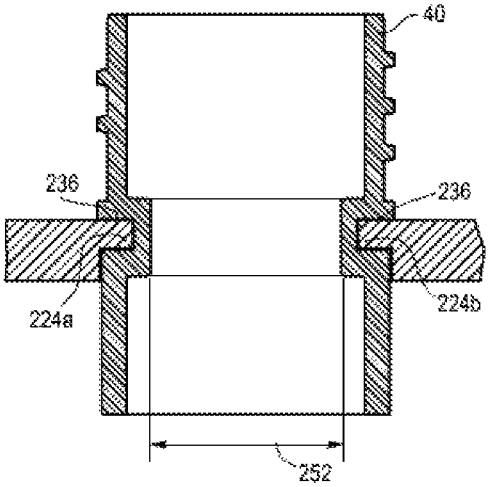
FIG. 7B is a sectional view taken along line 7B-7B of FIG. 7A.

Upon passing through the protrusions 240*a*, 240*b*, the fitment 40 finally arrives at the filling position 242 between the closed end 226 at the center portion 228 of the top plate 212, as shown in FIG. 7A. When the fitment 40 is slid through the protrusions 240*a*, 240*b* and has arrived at the filling position 242, the fitment 40 returns to the neutral diameter 252, as shown in FIG. 7A and FIG. 7B. In other words, the fitment width distance, as described above, is equal to the neutral diameter 252 of the fitment 40. The groove 236 of the fitment 40 is in contact with the arc segment 238 when the fitment 40 is at the filling position 242.

In an embodiment, the fitment 40 is a spout for a flexible container, as shown FIG. 3, FIG. 8, FIG. 9, and FIG. 10.

In support systems 10, 110, and 210, the fitment 40 is attached to a flexible container 300. The flexible container 300 includes four panels. Each panel includes a flexible multilayer film composed of a polymeric material. The four panels form a body 310, a neck 312, and optionally a handle. Fitment 40 is attached to, or otherwise sealed to, neck 312.

The flexible container 300 includes four panels, a rear panel, a front panel, and opposing gusset panels. Folded gusset panels are placed between the rear panel and the front panel to form a "panel sandwich." A first gusset panel opposes a second gusset panel. The edges of the panels are configured, or otherwise arranged, to form a common periphery. The flexible multilayer film of each panel is configured so that the heat seal layers face each other.

In an embodiment, flexible container 300 is a large volume flexible container. The term "large volume flexible container," as used herein, refers to a flexible container having four panels made of flexible films (or flexible panels), the flexible container having a volume from 3.8 liters to 9.5 liters. In an embodiment, the large volume flexible container 300 has a volume from 3.8 liters, or 4.0 liters, or 4.5 liters, or 5.0 liters, or 5.5 liters, or 6.0 liters, or 6.2 liters to 6.5 liters, or 7.0 liters, or 7.5 liters, or 8.0 liters, or 8.5 liters, or 9.0 liters to 9.5 liters. In a further embodiment, the large volume flexible container 300 has a volume from 3.8 liters to 9.5 liters, or from 4.0 liters to 9.0 liters, or from 4.5 liters to 8.5 liters, or from 5.0 liters to 8.0 liters, or from 5.5 liters to 7.5 liters, or from 6.0 liters to 7.0 liters, or from 6.2 liters to 6.5 liters.

Figure 8:
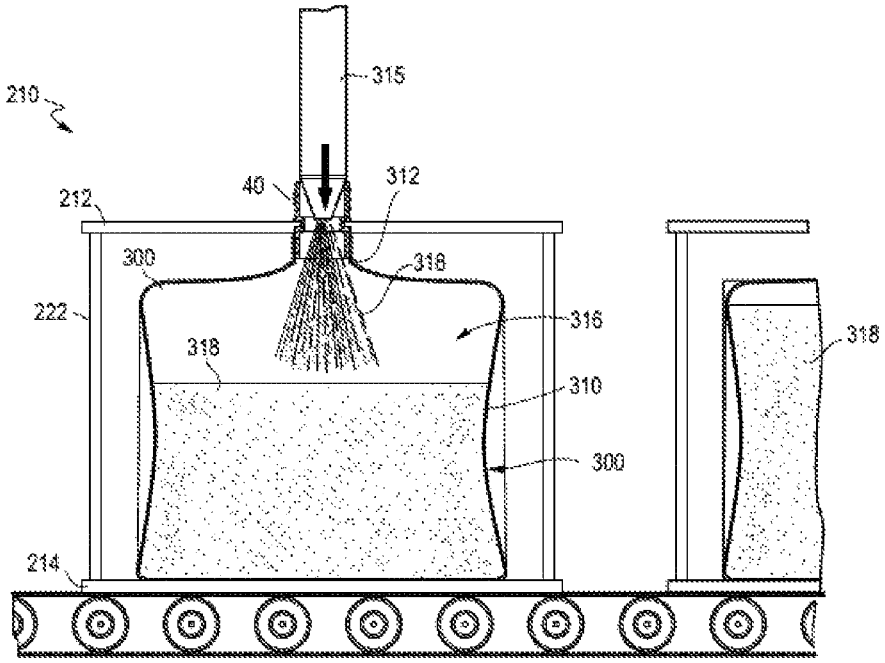
FIG. 8 is an elevation view of a flexible container being filled while supported by the support system, in accordance with an embodiment of the present disclosure.
Figure 9:
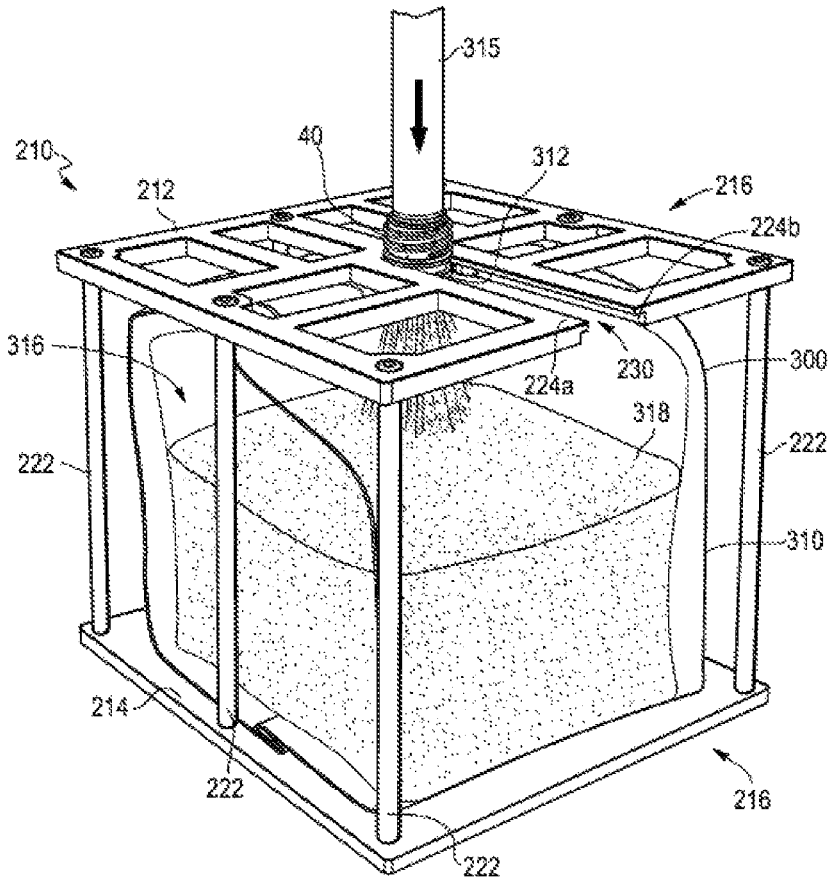
FIG. 9 is a perspective view of a flexible container being filled on a conveyor fill line while supported by the support system, in accordance with an embodiment of the present disclosure.
Figure 10:
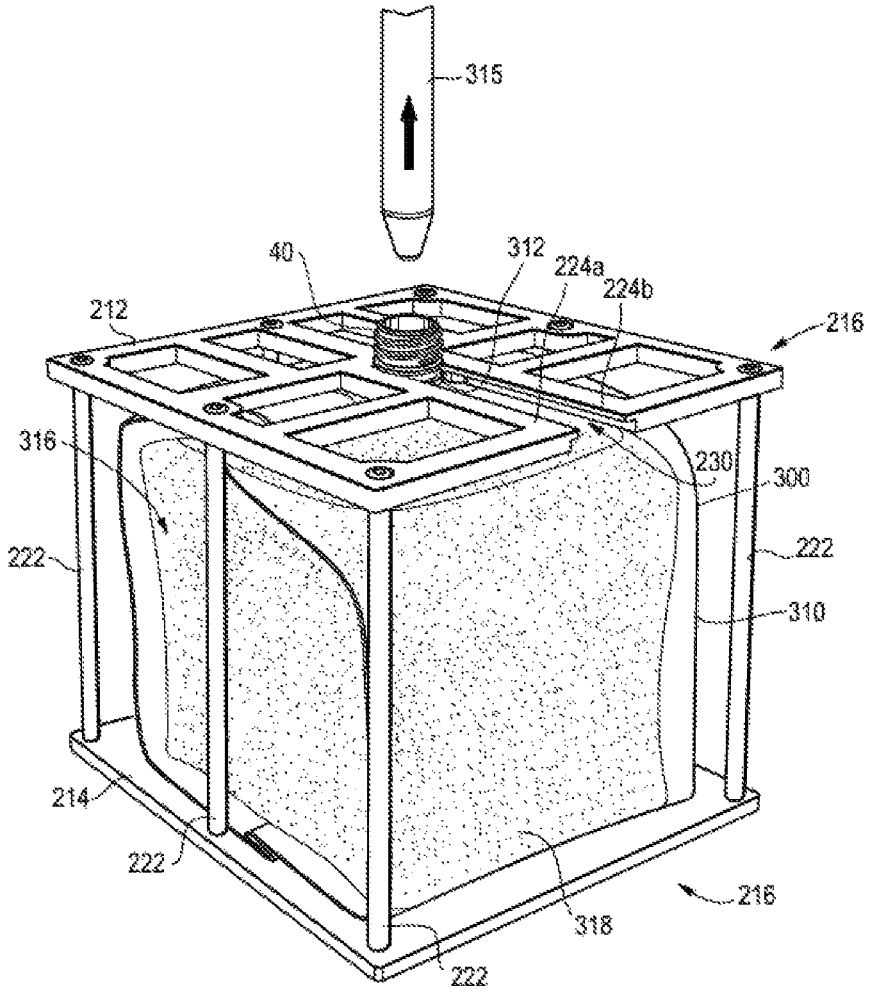
FIG. 10 is a perspective view of a filled flexible container on a conveyor fill line supported by the support system, in accordance with an embodiment of the present disclosure.

The large volume flexible container 300 is attached to the fitment 40 at neck 312. Base plate 214 of the support system 210 supports a bottom end 314 of the large volume flexible container 300 during filling by a filling tube 315, as shown in FIG. 8, FIG. 9, and FIG. 10. The large volume flexible container 300 has an interior chamber 316. During filling of the large volume flexible container 300, a flowable material 318 fills the interior chamber 316 of the large volume flexible container 300. When filling is complete, as shown in FIG. 10, the large volume flexible container 300 is in a fully-expanded form.

Support system 10, 110, 210 each facilitates filling of the large volume flexible container 300 by providing base plate (14, 114, 214) upon which the large volume flexible container 300 can rest during the filling process. Thus, compared to conventional fill lines, the support system 10, 110, 210 prevents the large volume flexible container 300 from breaking. Since the fitment 40 is locked into place at the filling position during the filling process, with the large volume flexible container 300 directly attached underneath, the support system 10, 110, 210 each prevents spillage of the flowable material 318, thus allowing for more efficient filling and reduction of waste. During the filling process, the large volume flexible container 300 expands into a final, full form four-sided flexible container that is supported by top/base plates and support structure 12/14/20 of support system 10; support structure 112/114/120 of support system 110; and support structure 212/214/220 of support system 210. The shape of the fully-expanded form of the four-panel large volume flexible container 300 is preserved at the end of the filling process.

It is specifically intended that the present disclosure not be limited to the embodiments and illustrations contained herein, but include modified forms of those embodiments including portions of the embodiments and combinations of elements of different embodiments as come within the scope of the following claims.

The invention claimed is:

1. A support system comprising:

a top plate;

a base plate, the top plate and the base plate having a common outer perimeter;

a support structure, the support structure supporting the top plate above the base plate;

a pair of parallel rails extending from the top plate outer perimeter to a closed end at a center portion of the top plate, the pair of parallel rails defining a channel;

a protrusion on each respective rail, each protrusion extending into the channel in mirror-image relation to each other, the protrusions located a fitment width distance away from the closed end, the protrusions and the closed end together defining a filling position; and a fitment for a flexible container in the channel.

2. The support system of claim 1 wherein the support structure comprises a plurality of spaced-apart vertical beams adjoining a first side of the top plate with a corresponding first side of the base plate.

3. The support of system of claim 1 wherein the support structure comprises a vertical wall, the vertical wall adjoining a first side of the top plate with a corresponding first side of the base plate.

4. The support system of claim 3, wherein the top plate and the base plate each has a second side opposite to the first side;

the support structure comprising the vertical wall; and a plurality of spaced-apart rods extending between the second side of the top plate and the second side of the base plate, the rods supporting the second side of the top plate above the second side of the base plate.

5. The support system of claim 4 wherein the second side has two corners; and at each corner, a rod extends between the second side of the top plate and the second side of the base plate.

6. The support system of claim 1, wherein the support structure comprises a plurality of rods spaced apart along the common outer perimeter of the top plate and the base, with the rods supporting the top plate above the base plate.

7. The support system of claim 1 wherein the common outer perimeter is a polygon.

8. The support system of claim 7 wherein the common outer perimeter comprises a plurality of corners; and a rod extends between the base plate and the top plate at each corner.

9. The support system of claim 1, wherein the closed end comprises an arc segment, the arc segment extending between the parallel rails.

10. The support system of claim 1 wherein the protrusions are integral to the rails, the protrusions and the rails composed of the same material that is a rigid polymeric material.

11. The support system of claim 1, wherein the protrusions are springs attached to the rails.

12. The support system of claim 1 wherein the fitment comprises a plurality of grooves for sliding engagement with the rails.

13. The support system of claim 12 wherein the fitment is composed of a polymeric material.

14. The support system of claim 13 wherein the fitment has a neutral diameter; and when the fitment is located between the protrusions, the fitment has a compressed diameter, the compressed diameter is less than the neutral diameter.

15. The support system of claim 14, wherein the fitment returns to the neutral diameter when the fitment is located at the fill position.

16. The support system of claim 1 wherein the fitment is attached to the flexible container, the flexible container having an interior chamber; and a flowable material is in the interior chamber.

17. The support system of claim 1, wherein the flexible container has a volume from 1.0 liter to 50 liters.

* * * * *